United States Patent [19]

Kvam

[11] 3,973,688

[45] Aug. 10, 1976

[54] BOTTLE CLOSURE

[76] Inventor: Ole Jacob Kvam, Waldemar Thranesgate 84B,, Oslo 1, Norway

[22] Filed: Aug. 28, 1974

[21] Appl. No.: 501,269

[30] Foreign Application Priority Data

Sept. 7, 1973 Norway ..... 3502/73

[52] U.S. Cl. ..... 215/272

[51] Int. Cl.[2] ..... B65D 45/32

[58] Field of Search ..... 215/272, 274, 275, 277; 220/319, 320

[56] References Cited

UNITED STATES PATENTS

| | | | |
|---|---|---|---|
| 2,586,440 | 2/1952 | Satz | 215/272 |
| 2,903,148 | 9/1959 | Keller | 215/272 |
| 3,680,731 | 8/1972 | Lelyk | 220/319 |

*Primary Examiner*—Donald F. Norton

*Attorney, Agent, or Firm*—Stevens, Davis, Miller & Mosher

[57] ABSTRACT

The invention is concerned with bottle closures, particularly for bottles containing carbonated beverages and the like and the main object is to provide a closure which represents a gastight seal independent of time and bottle contents, the bottle closure being easy to operate at any time.

According to the invention this is obtained in a bottle closure comprising a sealing member of resilient material slidably taken up in a retaining cap, wherein the sealing element is provided with an annular collar of an antifriction material, such as polypropylene or a similar material which is inert towards the actual gases and vapors, the annular collar forming a portion of the surface of the sealing element and is substantially the contact surface against the retaining cap.

4 Claims, 4 Drawing Figures

FIG. 2
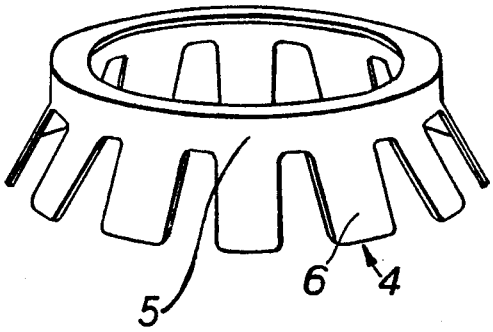
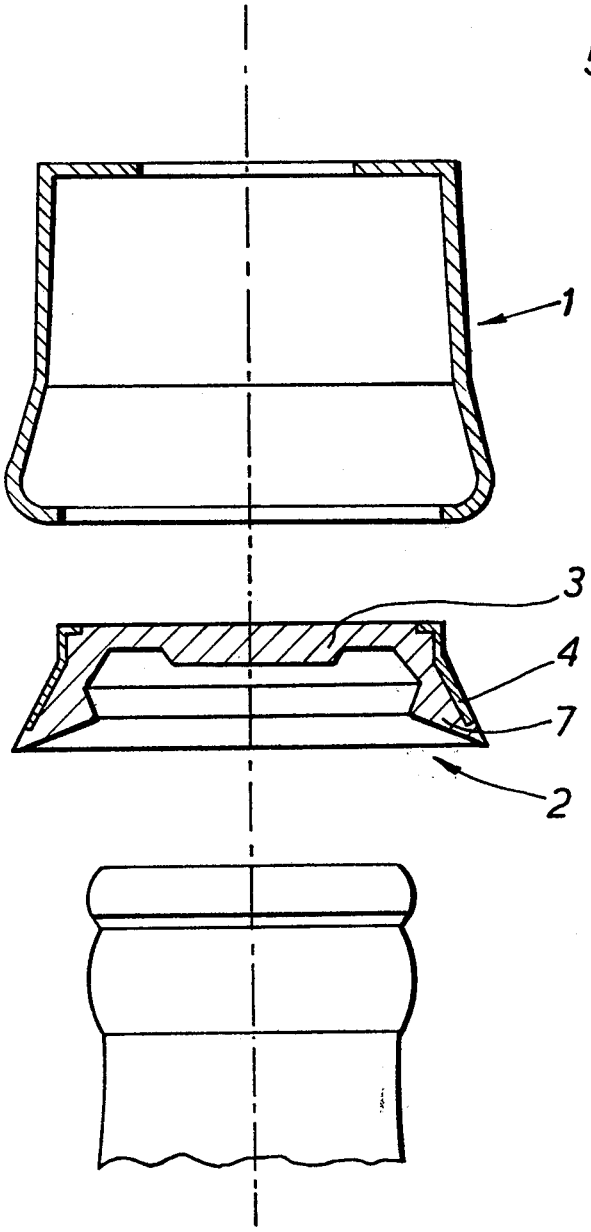
FIG. 1

BOTTLE CLOSURE

BACKGROUND OF INVENTION

This invention relates to a bottle closure for bottles having a circumferential bead around the bottle opening and which forms a downwardly directed external shoulder. The closure comprises a resilient sealing element slidably arranged in the hollow of a rigid retaining cap having a circular cross section and a side wall which is terminated at the top by a transverse top wall having a central aperture and which at the lower portion thereof is extended by means of a diverging skirt having an inwardly turned rounded flange. In its inactive position the sealing element will have a corresponding form but with substantially smaller axial dimension for sliding movement within the retaining cap between a lower resting position and an upper working position compressed around the opening of the bottle neck.

Such a bottle closure has been described and shown in U.S. Pat. No. 2,903,148.

The subject invention is directed to improvements over the above mentioned prior art which eliminate the various drawbacks in the known type of bottle closure. For instance, in the known bottle closure the internal contact surfaces between the slidable sealing element and the inner wall of the retaining cap must be impregnated with some sort of lubricating material to reduce frictional resistance to the movement of the sealing element between its two relative positions. Such lubricating material may be a silicone lubricant. However, these lubricating materials will be subjected to action from the gases or vapors contained in the liquid content of the bottle and the lubricating effect will disappear after a very short time. Furthermore, the bottle closures belonging to the art have proved to be ineffective in sealing when the bottles contain carbonated beverages. Also the sealing element in itself is subjected to structural deformations after a certain time, which again is very unfortunate for the sealing function and will lead to a very short lifespan for the bottle closure in question.

The subject invention has for its main purpose to eliminate said drawbacks in the prior art by providing a bottle closure having improved sealing characteristics and which furthermore is easy to operate, will have lower production costs and an extended lifespan compared with previously known constructions.

The invention meets the requirements by having a sealing element provided with an annular collar made from a friction reducing material such as polypropylene or similar material inert towards the actual gases and vapors. In accordance with a further feature of the invention the annular collar forms a portion of the external surface of the sealing element and is substantially the contact surface engaging the inner wall of the retaining cap. It is even a feature of the invention that the annular collar is made from a non-resilient material and has a skirt formed by downwardly directed flaps covering that portion of the sealing element which is subjected to deformation during movement from the resting position to the working position of the element.

Other objects and advantages will appear from the following description of an example of the invention with reference to the accompanying drawing and the novel features will be particularly pointed out in the appended claims.

FIG. 1 is a cross sectional exploded view of the retaining cap, sealing element, and the neck of a bottle to be sealingly closed.

FIG. 2 is a perspective view of the annular collar forming the characteristic feature of the present invention.

Figure 3:
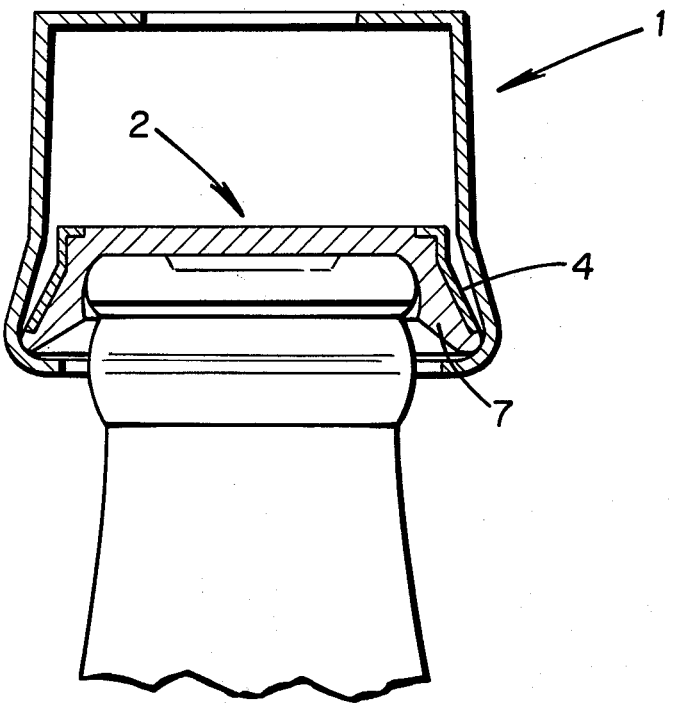
FIG. 3 is a sectional view of the invention in its release or non-sealing state with the retaining cap elevated relative to the rubber-like sealing member.

Referring to the drawings there is shown a bottle closure comprising a rigid retaining cap 1 and an elastic sealing element 2 positioned inside the retaining cap 1 but for better understanding shown separated from the cap in FIG. 1. The form of the retaining cap is different from corresponding parts of prior art in that the upper portion of the cap is slightly conical with its smallest diameter at the top so that the sealing element 2 during the sealing movement, that is when the bottle closure is pressed downwardly on a bottle neck and opening as at the bottom of FIG. 1, will be successively compressed and surround the bottle opening with increasing tightness until arriving at the end working position as shown in FIG. 3. For better sealing the sealing element is internally provided with a projection 3 in the bottom of the sealing element 2, said projection being exactly adjusted to the inside diameter of the bottle opening.

The novel and essential element in the present invention is an annular collar 4 which in FIG. 1 has been shown positioned on the sealing element 2 in such a way that the collar forms a portion of the surface of the sealing element. The sealing element 2 is molded with a contour so that collar 4 is imbedded in the circumference of the sealing element.

The purpose of the collar 4 is to prevent friction between the sealing element 2 and the internal wall of the cap 1 during the movement of the sealing element 2 upwards and downwards inside the cap 1 during operation of the bottle closure. For this purpose the collar 4 is preferably made from polypropylene or similar material which is non-resilient and which may withstand the actual gases and vapors which can occur in connection with beverages stored in bottles.

Figure 4:
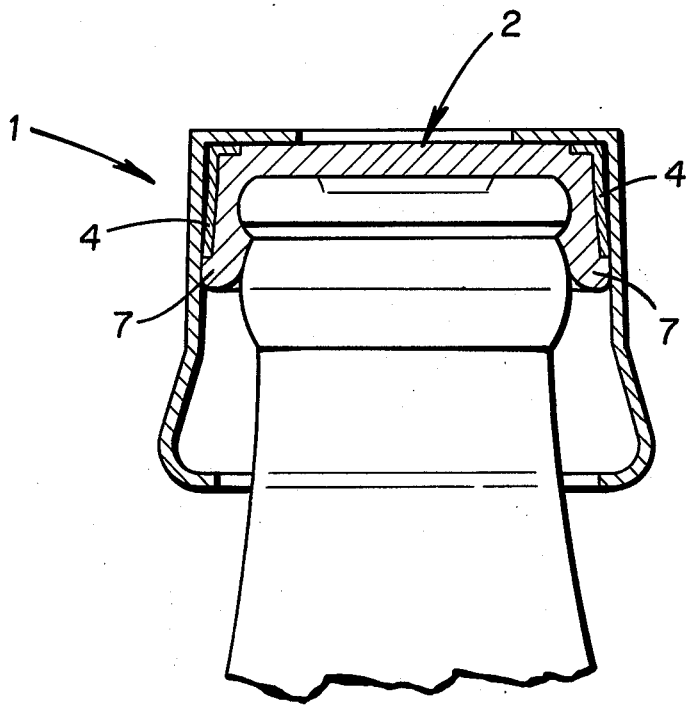
FIG. 4 is a similar view of the device in its closed or sealing state with the retaining cap depressed against the sealing member.

FIG. 2 is showing in greater detail and in perspective the form and construction of the collar 4 and it will be obvious that it is annular as by 5 having a skirt formed by flaps or tongues 6 so that the collar will adjust itself to the sealing skirt 7 of the sealing element (see FIG. 1) when the sealing element 2 as positioned in FIG. 3 is compressed during the closing operation during which it is pressed upwardly inside the retaining cap 1 to the position of FIG. 4.

A bottle closure provided with an annular collar on the sealing element of the kind described and shown here will have a long lifetime and a very good sealing effect.

It is claimed:

1. A closure for a bottle having a rim bead forming a downwardly directed outer circumferential shoulder, said closure comprising a sealing member of resilient material, an annular collar carried thereby and a rigid retaining cap within which said member and collar are slidably mounted, said cap having a circular cross-section with a side wall terminating at the top by a transverse top wall having a central aperture and having a downwardly extending flared skirt terminating in a rounded inwardly turned circumferential flange, said sealing member having a transverse top wall to seat removably across the top of said rim bead of said bottle and a downwardly extending continuous circumferential skirt integral with said top wall to surround said bead and circumferential shoulder, said skirt of said member having an inner circumferential rib to engage said shoulder and when not engaging said shoulder being flared downwardly and outwardly to clear said rim bead to permit the sealing member to be mounted on the bottle and to be lifted away from said bottle without interference with said rim bead, said member carrying an annular collar extending over the edge of the top wall and over the downwardly extending skirt, said collar being in slidable contact with the interior surface of said cap, said sealing member and collar when not engaging said rim bead and circumferential shoulder being positioned within the flared skirt position of said cap and when engaging said rim bead and circumferential shoulder being positioned within said cap in contact with said transverse wall of said cap.

2. The bottle closure of claim 1 wherein said annular collar is imbedded in the sealing member.

3. The bottle closure of claim 1 wherein said annular collar is formed of non-resilient material and carries flaps depending therefrom to cover a portion of said sealing member skirt.

4. The bottle closure of claim 1 wherein said transverse top wall of said sealing member has a circular projection to fit within bottle opening.

* * * * *